US005862616A

United States Patent [19]

Peroni

[11] Patent Number: 5,862,616

[45] Date of Patent: Jan. 26, 1999

[54] LOCKING PLATE

[75] Inventor: Peter A. Peroni, Pottstown, Pa.

[73] Assignee: LaFrance Corp., Philadelphia, Pa.

[21] Appl. No.: 669,154

[22] Filed: Jun. 24, 1996

[51] Int. Cl.[6] ..... G09F 7/06

[52] U.S. Cl. ..... 40/611; 40/622

[58] Field of Search ..... 40/64, 373, 657, 40/618, 622; 24/618, 625

[56] References Cited

U.S. PATENT DOCUMENTS

| | | | |
|---|---|---|---|
| 3,918,635 | 11/1975 | Gilomen | 40/657 |
| 5,054,057 | 10/1991 | Wilson | 40/336 |
| 5,584,133 | 12/1996 | Motooka et al. | 40/299 |

FOREIGN PATENT DOCUMENTS

| | | | |
|---|---|---|---|
| 2646268 | 10/1990 | France | 40/627 |
| 438872 | 11/1935 | United Kingdom | 40/373 |
| 465800 | 5/1937 | United Kingdom | 40/373 |

*Primary Examiner*—Cassandra H. Davis
*Attorney, Agent, or Firm*—Connolly & Hutz

[57] ABSTRACT

A locking plate comprises a thin generally resilient plate member capable of being bent out of its normal condition and tending to return to its normal condition upon release of the bending force. A securing leg is mounted at each of the end edges of the plate member extending outwardly away from the exposed surface of the plate member. Each of the securing legs terminates in an outwardly directed locking flange so that the plate may be mounted to a support member having holes in the support member by flexing the plate member out of its normal condition to permit one of the locking flanges to be inserted through the hole and then inserting the other locking flange through another hole in the support member whereupon the plate is permitted to return toward its original condition.

7 Claims, 2 Drawing Sheets

LOCKING PLATE

BACKGROUND OF THE INVENTION

There is a need to provide locking plates such as nameplates which could be readily secured to various support surfaces, such as file cabinets having a flat outer wall or to hollow posts having arcuate walls. Frequently the support surfaces have limited access which adds to the difficulty in being able to firmly secure the locking plate or nameplate in place, much less being able to secure the plate in place in a quick and convenient manner.

SUMMARY OF THE INVENTION

An object of this invention is to provide a locking plate which meets the above needs.

A further object of this invention is to provide such a locking plate which could be mounted against flat surfaces or curved surfaces.

In accordance with this invention the locking plate comprises a generally stiff, yet resilient plate member capable of being bent out of its normal condition but tending to return to its normal condition upon release of the bending force. The plate member has a securing leg at each of its ends extending outwardly from the support contacting surface of the plate member in a direction away from the exposed surface of the plate member. Each of the legs terminates in an outwardly directed locking flange which extends outwardly beyond its edge. The locking plate may be conveniently mounted in place against a support member having holes by flexing the plate member and inserting one of the locking flanges through one of the holes of the support member, then while the plate member is still flexed the other locking flange is inserted into another corresponding hole in the support member. Upon release of the plate the plate tends to resume its normal condition which would be disposed toward contacting the support member. The plate is thereby then firmly locked in place.

In one practice of the invention, the outer edge of the plate terminates at the leg which would result in the holes in the support member being somewhat exposed. In an alternative practice each outer edge may include an extension at its leg to cover the holes.

A recess may be provided in the legs where the holes in the support member are formed by piercing which would create material extending outwardly from the support member whereby the recess could accommodate such outwardly pierced material.

For long plates at least one locking stud may be secured to the plate on the same side as the legs to fit into a corresponding hole in the support member and thereby enhance the stability of mounting.

THE DRAWINGS

DETAILED DESCRIPTION

Figure 5:
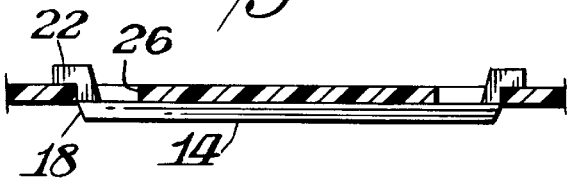
FIG. 5 is a cross-sectional view taken through FIG. 4 along the line 5—5.

FIGS. 1–5 illustrate a locking plate 10 in accordance with this invention which would be mounted to a support member 12. As shown therein, locking plate 10 comprises a thin generally stiff, yet resilient plate member 14 capable of being bent out of its normal condition (see FIG. 3) and tending to return to its normal condition upon release of the bending force as shown in FIG. 5. In the illustrated embodiment the normal condition is with the plate 14 being planar. The normal condition, however, may also be somewhat arcuate.

Plate member 14 includes an inner support contacting surface 16 terminating in an end edge 18 at each end of plate member 14. An outer exposed surface 20 is disposed opposite the support contacting surface 16.

A securing leg 22 is mounted at each edge 18. As shown each securing leg 22 extends outwardly away from the support contacting surface 16 in a direction away from the exposed surface 20. Each of the legs 22 terminates in an outwardly directed flange 24 extending outwardly beyond its respective end edge 18. Flange 24 is connected to surface 16 by extension or connecting portion 30.

Figure 1:
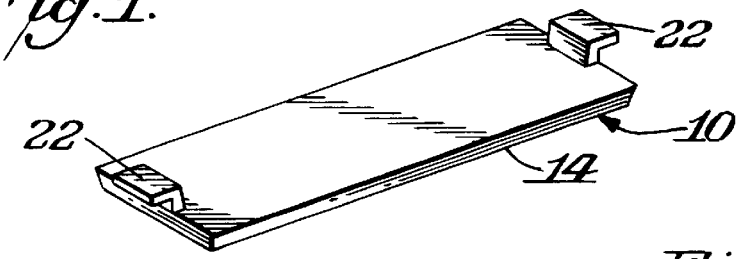
FIG. 1 is a perspective view of a locking plate in accordance with this invention.
Figure 2:
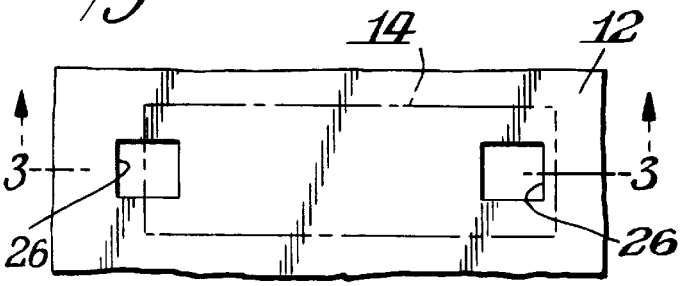
FIG. 2 is a front elevational view showing the locking plate of FIG. 1 mounted against a support member.
Figure 3:
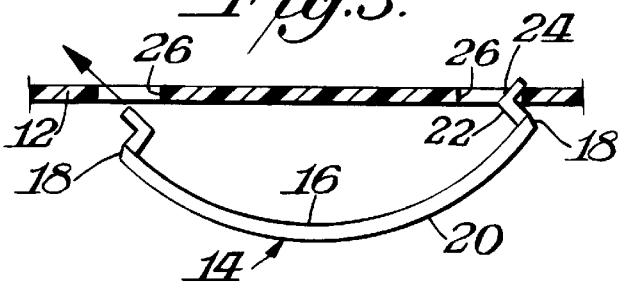
FIG. 3 is a cross-sectional view taken through FIG. 2 along the line 3—3 showing the steps of mounting the locking plate to the support member.
Figure 4:
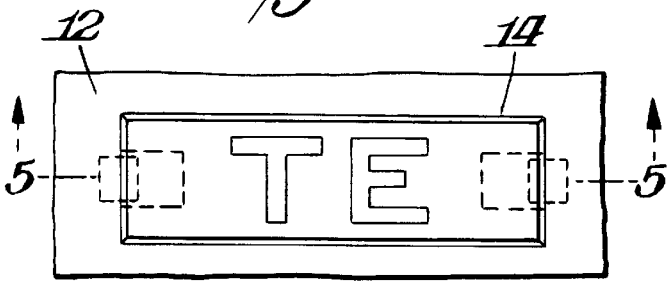
FIG. 4 is a front elevational view showing a locking plate mounted in place.

As shown in FIGS. 2–4 the support member 12 includes a set of holes 26 extending completely through the wall of the support member 12. The holes 26,26 are spaced apart a distance at least slightly less than the distance between legs 22,22 when plate member 14 is in its normal condition.

In order to mount locking plate member 10 to support member 12 it is necessary to first insert one of the legs 22 into a hole 26 until the locking flange 24 is completely through the hole. This can be done by either inserting the leg through the hole while the plate member 14 is in its normal condition or can be done by first flexing the plate member 14.

After one of the legs 22 is inserted through its hole 26, as shown in FIG. 3, the other leg 22 is then inserted through its corresponding hole 26 by flexing plate member 14 a sufficient amount to permit the locking flange 24 to pass through the hole. Upon release of the locking plate the locking plate snaps toward its original condition which with properly spaced apart holes 26,26 would result in a surface to surface contact of inner support contacting surface 16 and the outer surface of support member 12 as shown in FIG. 5. If the holes are closer together than illustrated in FIG. 5, there might be a slight spacing between the inner surface 16 and the outer surface of support member 12.

The locking action is accomplished by forcing the flange when using a line fit or by snapping when using a lock fit.

Figure 6:
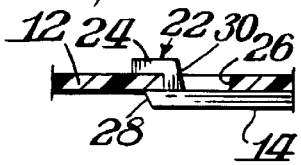
FIGS. 6–7 are fragmental plan views in cross section showing a modified forms of locking plate in accordance with this invention.
Figure 7:
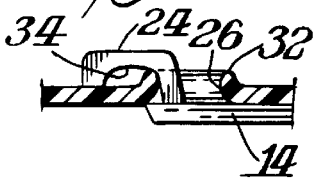

In the embodiment shown in FIGS. 1–5 the edge 18 terminates at the leg 22. This would result in the holes or knockouts 26 being at least slightly exposed. FIG. 6 illustrates an alternative embodiment wherein edge 18 includes an extension 28 which extends partially beyond the connecting portion 30 of leg 22. When mounted in place the extension 28 covers the hole or knockout 26. The version of the plate shown in FIG. 6 would require greater care in mounting the plate to the support member to assure that the wall of support member 12 is properly positioned between the flange 24 and extension 28 of the plate.

Where the hole or knockout is punched or otherwise similarly formed, such as by a punch and die procedure, there is no excess material around the periphery of the hole 26 as illustrated in FIGS. 3, 5 and 6. The invention, however, may be used, preferably with modification to accommodate holes or knockouts formed by piercing or punching without the use of a die which would result in a round or tubular extension of material 32 peripherally around the hole 26. In such cases, a recess 34 is formed in the flange 24 to accommodate the excess material 32.

Figure 8:
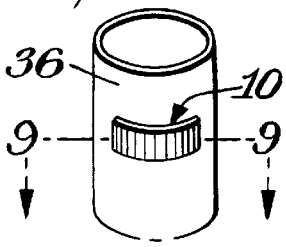
FIG. 8 is a perspective view showing a locking plate mounted to a cylindrical support member.
Figure 9:
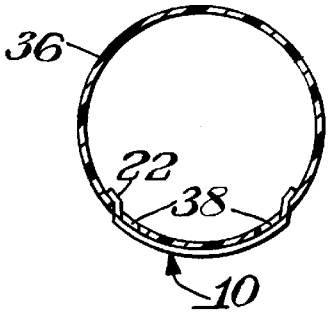
FIG. 9 is a cross-sectional view taken through FIG. 8 along the line 9—9.
Figure 5A:
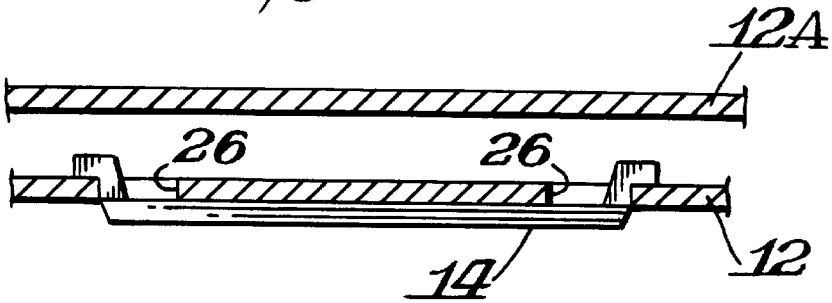
FIG. 5A is a view similar to FIG. 5 showing use of the invention with a double wall structure.

FIGS. 2–5 illustrate the locking plate 10 to be mounted to a flat member. Such a flat member might, for example, be a wall of a file cabinet or a file cabinet drawer wherein there is no access to the rear surface of the supporting wall in that the supporting wall is the front wall 12 which is spaced from a rear wall 12A to create a hollow space therebetween, as shown in FIG. 5A. FIGS. 8–9, however, illustrate a variation wherein the support member 36 is of tubular or arcuate shape such as being a pipe post. Plate 10 could still be mounted to the tubular support surface in the same manner as previously described with respect to FIGS. 1–5 by inserting the legs 22 through holes 38 in the tubular support member 36.

Where locking plate 10 is of a generally small length, such as, for example, less than 2½ inches, there is sufficient stability and secure mounting simply by the provision of the legs 22. The invention, however, may be practiced with longer nameplates such as shown in FIGS. 10–11.

Figure 10:
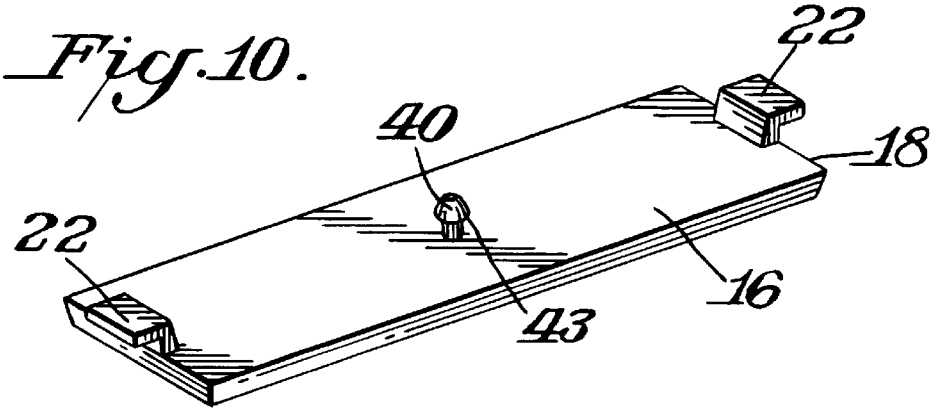
FIG. 10 is a perspective view of yet another form of locking plate in accordance with this invention.
Figure 11:
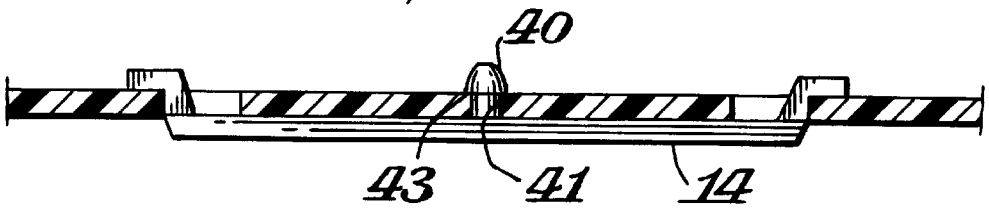
FIG. 11 is a cross-sectional plan view showing the locking plate of FIG. 10 mounted to a support member.

As shown in FIGS. 10–11 one or more studs 40 is mounted at any suitable locations on the inner surface 16 of plate 10. Preferably the studs are located equidistant between the legs 22. Thus, where a single stud is used as shown in FIG. 10 a stud 40 would be located at the direct center of the inner surface 16. If two studs were used each stud would be located about ⅓ the distance inwardly from the edges 18.

Figure 12:
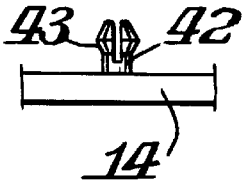
FIGS. 12 and 13 are fragmental elevational views showing alternative forms of studs which may be used with the locking plate of FIGS. 10–11.
Figure 13:
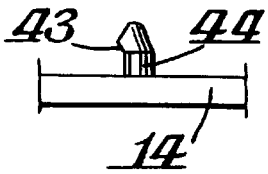

Studs 40 may take any suitable shape. For example, as shown in FIG. 12 a split stud 42 of known construction may be used on plate member 14. FIG. 13 illustrates a snap fit stud 44 on plate member 14. The studs may be of the construction of the single blade locking studs shown in U.S. Pat. Nos. 5,233,870 and 5,362,186 and application Ser. No. 300,744, filed Sep. 6, 1994, all of the details of which are incorporated herein by reference thereto.

Preferably, locking studs are used where the plate 10 has a length greater than 2½ inches. For mounting such a blocking plate to a support member or panel the locking would take place in the manner previously described by first securing one leg in place through its respective hole or knockout and then securing the other leg in place. Upon the plate member 14 tending to return to its original condition the locking studs would tend to move toward appropriately located additional holes in the support member. If necessary, a force or pushing pressure could be exerted against the outer surface of the plate member to assure that the studs are snapped into a locking condition in their corresponding holes, such as hole 41 shown in FIG. 11.

Once the stud projects completely through hole 41 the stud is firmly locked in place by shoulder 43 engaging against the inner surface of the panel or support member 12.

As shown in FIG. 13 snap stud 44 includes an offset outer portion forming the shoulder 43.

The preferred practice of the invention utilizes only a single leg at each edge 18. It is to be understood, however, that for wider plates two or more legs could be mounted on one or both of the edges to fit into corresponding holes in the support member.

It is further to be understood that the invention may be practiced by incorporating features from one embodiment into other embodiments.

Any suitable materials may be used for forming the locking plates and components. Preferably the locking plates and components are of a unitary one piece molded plastic material which is generally rigid or stiff but has enough flexibility to permit a bending of the plate.

What is claimed is:

1. A locking plate comprising a thin generally stiff and resilient plate member capable of being bent out of its normal condition and tending to return to its normal condition upon release of the bending force, said plate member having an inner support contacting surface terminating in an end edge at each end of said plate member, said plate member having an outer exposed surface opposite said contacting surface, a securing leg at each of said end edges extending outwardly away from said support contacting surface in a direction away from said exposed surface, each of said legs being made of a stiff material generally of L shape with a connecting member and a locking flange, said connecting member being secured to said inner support surface and extending generally perpendicularly away from said inner support surface, said locking flange being spaced from said inner support surface and extending outwardly from said connecting member and extending outwardly beyond its respective one of said end edges, said locking flange extending outwardly from said connecting member a greater distance than the distance said locking flange extends from said inner support surface of said plate whereby said locking flange may make surface contact with a thin support member, said plate being longer than the distance between said connecting members, said locking flanges extending away from each other, each of said locking flanges terminating in an outer edge, and said outer edges of said locking flanges being spaced apart by a distance greater than the distance said end edges of said plate are spaced from each other to create an outward extension of said locking flanges laterally beyond said plate whereby said locking plate may be mounted to a support member having holes through the support member spaced apart by a distance generally corresponding to the distance between said end edges by flexing said plate member out of its flat normal condition without flexing said stiff locking flanges and with said end edges moved toward each other and by then inserting one of said legs into one of the holes until said locking flange of said one of said legs is through its one hole and then inserting the other of said legs into the other of the holes until said locking flange of said other of said legs is through its respective hole whereupon said plate member may be released to snap against the support member with said locking flanges and their outward extensions preventing said plate member from being detached from the support member.

2. The locking plate of claim 1 wherein each of said end edges terminates at said leg.

3. The locking plate of claim 1 in combination with a support member, and said locking plate being a nameplate.

4. The combination of claim 3 wherein said support member is flat and planar.

5. The combination of claim 4 wherein said support member is of arcuate shape.

6. The locking plate of claim 1, in combination with a support member, said support member having a wall with a pair of spaced holes, said locking flanges being inserted through said holes, said wall having an outer surface and an inner surface, said inner support surface of said plate member being disposed toward said outer surface of said wall, said locking flanges being disposed toward said inner surface of said wall, and said wall having a thickness less than said distance said locking flanges extends outwardly from said connecting member.

7. The combination of claim 6 wherein said support member wall is a front wall, and said support member further including a rear wall blocking access to said front wall.

* * * * *